US010837220B1

(12) United States Patent
Kelley

(10) Patent No.: US 10,837,220 B1
(45) Date of Patent: Nov. 17, 2020

(54) INSULATED DIAMOND PLATE BACKED NOVEL PORTIONS OF A GARAGE DOOR PANEL

(71) Applicant: Robert A. Kelley, Buena Park, CA (US)

(72) Inventor: Robert A. Kelley, Buena Park, CA (US)

( * ) Notice: Subject to any disclaimer, the term of this patent is extended or adjusted under 35 U.S.C. 154(b) by 0 days.

(21) Appl. No.: 16/591,430

(22) Filed: Oct. 2, 2019

(51) Int. Cl.

| | |
|---|---|
| ***E06B 3/30*** | (2006.01) |
| ***E06B 5/20*** | (2006.01) |
| ***E06B 3/48*** | (2006.01) |
| ***E06B 3/70*** | (2006.01) |

(52) U.S. Cl.
CPC ..... *E06B 3/30* (2013.01); *E06B 3/485* (2013.01); *E06B 3/7015* (2013.01); *E06B 5/20* (2013.01); *E06B 3/7001* (2013.01); *E06B 2003/7023* (2013.01); *E06B 2003/7044* (2013.01); *E06B 2003/7051* (2013.01)

(58) Field of Classification Search
CPC ..... E06B 3/30; E06B 3/485; E06B 3/7015; E06B 5/20; E06B 2003/7044; E06B 3/7001; E06B 2003/7023; E06B 2003/7051
USPC ..... 52/794.1
See application file for complete search history.

(56) References Cited

U.S. PATENT DOCUMENTS

| | | | | |
|---|---|---|---|---|
| 4,518,026 | A * | 5/1985 | Otto | E06B 3/827 160/201 |
| 5,787,677 | A * | 8/1998 | Bolich | B32B 11/10 52/784.15 |
| 8,858,402 | B2 * | 10/2014 | Bruschke | A63B 23/03541 482/51 |
| 10,407,976 | B1 | 9/2019 | Kelley | |
| 2013/0206016 | A1 * | 8/2013 | Diaz | A47J 37/0704 99/339 |
| 2016/0282033 | A1 * | 9/2016 | Jorgensen | F04D 25/166 |
| 2018/0117874 | A1 * | 5/2018 | Rothbauer | B32B 27/065 |

FOREIGN PATENT DOCUMENTS

JP 63132099 A * 6/1988

* cited by examiner

*Primary Examiner* — Jeanette E Chapman
(74) *Attorney, Agent, or Firm* — Rozsa Law Group LC

(57) ABSTRACT

An apparatus and method for forming new and novel portions of a garage door panel. This includes forming at least one decoration into a steel plate section and bonding to it a unique foam core where a mirror image decoration is routed into the foam core to exactly match the decoration. In addition, an aluminum diamond plate sheet with a front surface and a rear surface is bonded to the rear of the foam core. The aluminum diamond plate sheet also includes a sheet of steel affixed to its rear surface which rear surface is bonded to the foam core so that magnetic decorations can be attached to the front of the aluminum diamond plate sheet.

10 Claims, 15 Drawing Sheets

INSULATED DIAMOND PLATE BACKED NOVEL PORTIONS OF A GARAGE DOOR PANEL

BACKGROUND OF THE INVENTION

1. Field of the Invention

This invention relates to the field of garage doors. Specifically, this invention relates to garage door paneling and an improvement for the paneling that is used in garage doors.

2. Description of the Prior Art

The inventor is not aware of any prior art patents or published patent applications which either identically disclose or make obvious the invention disclosed and claimed in the present patent application.

The closest patent of which the inventor is aware is U.S. Pat. No. 10,407,976 for "Garage Door Insert" issued to the inventor on Sep. 10, 2019.

Most insulated steel sandwich garage doors are made of a steel skin on the outside and a steel skin on the inside. Foam is placed in the center to provide insulation and strength. The sandwich style insulated garage door is known in the garage door industry. However, these garage door panels are heavy and not aesthetically pleasing.

There is a significant need for an improved sandwich style garage door panel which is lighter in weight than existing steel sandwich garage door panels.

There is also a significant need for an improved sandwich style garage door panel which is more aesthetically pleasing than existing steel sandwich garage door panels.

SUMMARY OF THE INVENTION

The present invention is an apparatus and a method for forming new and novel additional portions of a garage door panel which is comprised of a formed metal section with at least one decorative portion which is stamped, embossed, indented or otherwise formed into the front surface leaving raised design areas on the front surface and matching corresponding depressed areas into the back surface of the panel to match the designs. The metal section also includes a formed metal section including a top male tongue portion which extends for the entire length of the panel section and a bottom female groove portion which extends for the entire length of the panel section.

One key innovation of the present invention is the backing material which includes an Expanded Polystyrene (EPS) core of 1.5 to 2.0 pound foam (hereafter "EPS foam core"). Instead of notching out the foam to clear the raised panel embossment which is known in the prior art, the present invention includes mirror matching the corresponding front surface of the EPS foam core which serves as a backing piece by custom routing out to a very close tolerance each portion of the corresponding front surface of the EPS foam core to fit the embossed design in the formed metal section of the garage door panel.

Through this new and improved process, there is left just enough room for glue or other adhesive applied to both a rear surface of the embossed design on the front steel garage door panel and glue or other adhesive on the matching routed out portion of the EPS foam core to provide a solid flex-free fit and gap-free attachment bond between these two areas. The tight fit provides significantly improved strength over prior art notches and clear front surface removal on the corresponding front surface of the EPS foam core.

While several different adhesives or adhesive combinations are within the spirit and scope of the present invention, a spray of isocyanate combined with polyol resin which are separately sprayed onto each surface and then are mixed together on the surface to form a hardened polyurethane is a preferred adhesive.

Therefore, the front surface of the EPS foam core is identically sized and shaped to match the embossed interior surface of the embossed garage door panel. The rear surface of the EPS foam core is a smooth flat surface. The front garage door panel is made of steel, has a stamped or otherwise embossed design on its front surface and a stamped upper section having a male tongue and a stamped lower section having a female groove. The rear area of the garage door panel has an interior cavity bounded by the interior embossed design front wall, a lower wall of the male tongue and an upper wall of the female groove and straight left and right sidewalls. The EPS foam core exactly matches the stamped interior cavity. The flat rear surface of the EPS foam core faces a backing plate. The EPS foam core is sized to exactly fit within the interior cavity of the stamped panel section.

Another significant improvement of the present invention is adding a sheet of aluminum diamond plate backing against the flat back wall of the EPS foam core, A flat metal sheet, preferably made of steel, is affixed to a rear interior surface of the aluminum diamond plate sheet. Magnetic decorations are affixed to a front surface of the aluminum diamond plate sheet and are magnetically retained by the steel sheet.

In production, the steel embossed front plate of the garage door panel is placed face down on a transport roller which runs under a structure having adhesive spray nozzles spraying adhesive onto the back surface of the embossed steel plate. The rear surface of the front embossed steel garage door panel section is spray coated with a combination of isocyanate combined with polyol resin which is mixed together on the front surface of the EPS foam core to form a hardened polyurethane foam section. The embossed decorative routed out front surface of the EPS foam core is also spray coated with a combination isocyanate combined with polyol resin which is mixed together on the rear surface to form a hardened polyurethane foam section. The embossed decorative routed front surface is pressed against the interior embossed rear surface of the garage door panel section and bonded together.

The length, width and depth dimensions of the EPS foam core are sized to exactly fit within the interior rear cavity of the front garage plate section. The embossed decorative routed front surface is pressed to exactly fit within the interior rear cavity of the front garage plate section.

The flat rear surface of the EPS form core is sprayed with adhesive including a combination isocyanate combined with polyol resin which is mixed together on the rear surface of the EPS foam core to form a hardened polyurethane foam section.

The smooth back surface of the EPS foam core is coated with adhesive such as a combination of isocyanate polystyrene. The rear surface of the aluminum diamond plate sheet with steel strip is also coated with adhesive such as a combination of isocyanate and polyol resin to form a polyurethane foam coating and is bonded to the smooth back surface of the EPS foam core.

The completed section of the present invention garage door panel includes the embossed design steel plate, the front surface matching routed design EPS foam core affixed therein, and the aluminum diamond plate with an interior steel sheet affixed to the back of the EPS foam core.

A left metal stile is affixed to and covers the left end of the completed garage door panel and a right metal stile is affixed to and covers the right end of the completed garage panel to provide a secure structure to which hinges are attached. For panels longer than eight (8) feet, one or more middle stiles are added.

The embossments on the interior of the diamond plate aluminum provide small indents to catch/hold more of the wet urethane glue to provide a superior bond between the EPS foam core and the rear surface of the aluminum diamond plate backing sheet. This further provides superior added strength to the garage door panel with identically sized and shaped rear surface due to the extra bonding. In addition, a slower cure pressure bonding process provides the harder-to-bond aluminum diamond plate with a stronger permanent attachment to the EPS foam core.

The rear surface of the aluminum diamond plate backing sheet includes a sheet of steel retained against the interior surface of the aluminum diamond plate sheet, either by pressure or adhesive, and the rear surface of the diamond plate aluminum backing is spray coated with glue or a combination of isocyanate combined with polyol resin which is mixed together on the rear surface of the aluminum diamond plate and the EPS foam core to form a hardened bond.

The rear surface of the aluminum diamond plate sheet is spray coated with a combination isocyanate and polyol resin which combines to form as a hardened polyurethane foam section. The flat rear wall of the EPS foam core is spray coated with a combination isocyanate and polyol resin to bond the two surfaces together.

The present invention also includes the method of making the panel.

It is an object of the present invention to provide a lightweight, noise reducing garage door panel that has an aluminum diamond plate backing sheet instead of steel. The front of the aluminum diamond plate is embossed, is aesthetically pleasing and does not require painting.

It is an additional object of the present invention to provide a strong and lightweight garage door panel. A sandwich-style steel front door and steel back door weigh approximately two hundred and forty-five pounds for only the door sections for a double-car garage. The present invention newly improved aluminum diamond plate back door weighs one-hundred and ninety pounds for only the door sections of a double car garage. This is a fifty-five pound weight savings making the door lighter and stronger, reducing the spring force needed and spring size needed to lift the door. This reduces cost and facilitates less wear and tear on hardware hinges and rollers.

It is also an object of the present invention to incorporate a six inch wide steel backing plate for hinge and screw attachments which creates an additional benefit as a plate providing a source of magnetic attachment. As a result, decorative signs, decorative plastic bolts, etc. are placed on an aluminum diamond plate backing sheet without glues or screws, thereby reducing garage door weight even more and allowing the owner to customize their garage door. This is a significant improvement over prior art two-inch to three-inch backing plates.

In addition, it is also an object of the present invention to incorporate black instead of white window retainer frames which are used along with black end styles, black hardware and track to make for a very custom interior.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
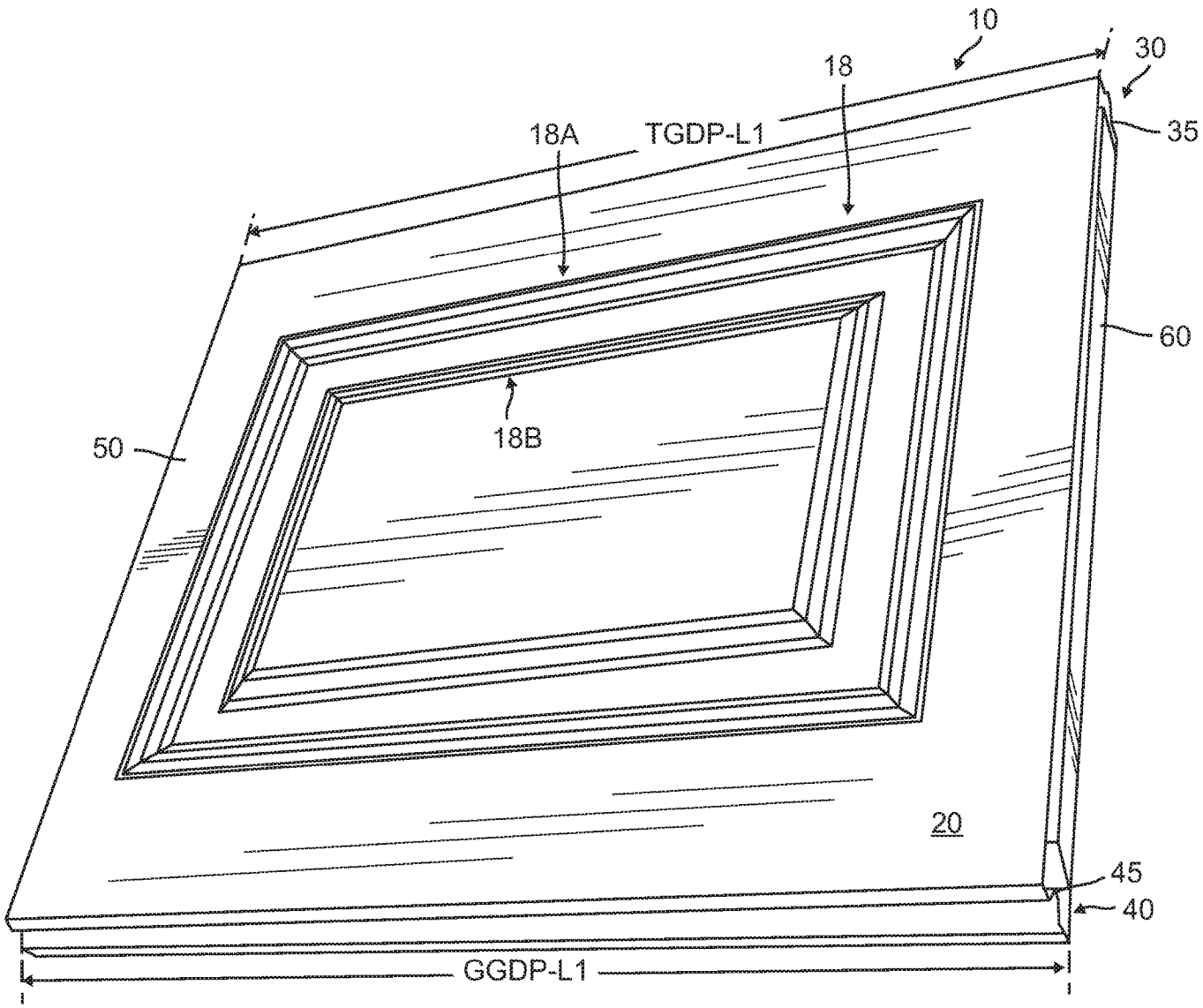
FIG. 1 is a front and right side perspective view of a garage door panel with a decorative design stamped into the panel as viewed from the front of the panel.
Figure 2:
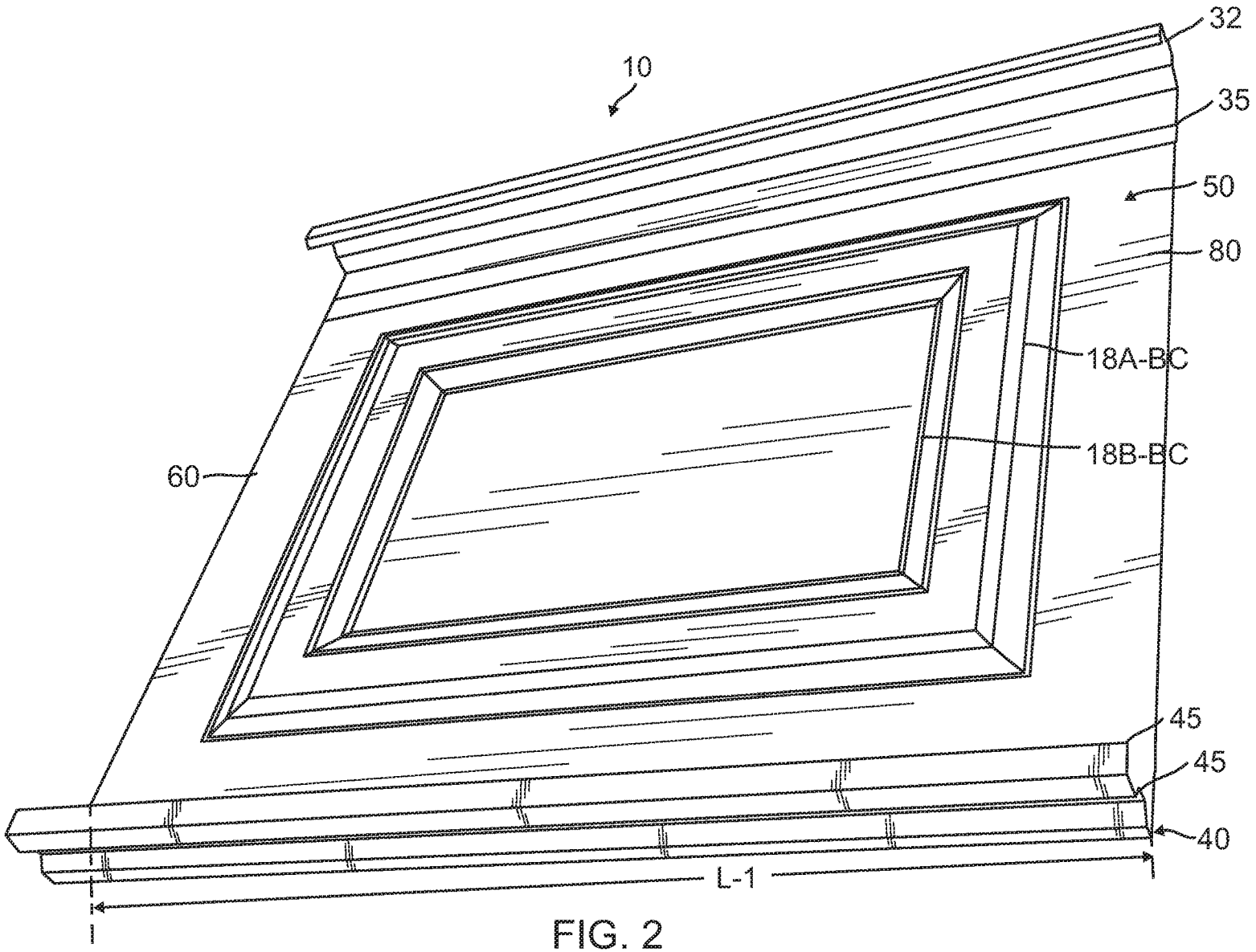
FIG. 2 is a rear and left side perspective view of a garage door panel with the panel rotated one-hundred and eighty degrees in the horizontal direction, with a decorative design stamped into the panel as viewed from the rear of the panel.

Referring to FIG. 1, there is illustrated a front and right side perspective view of a garage door panel with a decorative design stamped into the panel as viewed from the front of the panel. Referring to FIG. 2, there is illustrated a rear and left side perspective view of a garage door panel with the panel rotated one hundred and eighty degrees in the horizontal direction, with a decorative design stamped into the panel as viewed from the rear of the panel.

Referring to FIG. 1, the garage door panel section 10 includes a metal plate with a flat front surface 20 into which is formed a decoration 18 which is preferably stamped into front surface 20 from a rear surface 70 (See FIG. 2). For illustration and by way of example, the stamped design 18 includes an exterior generally rectangular portion 18A and an interior generally rectangular portion 18B which are centered on panel 10. As illustrated in FIG. 1, the protrusions 18A and 18B protrude outwardly from the front surface 20. As illustrated in FIG. 2, the protrusions 18A and 18B extend into the rear surface 70 of panel 10 and are numbered 18A-BC and 18B-BC. The garage door panel section 10 as illustrated in FIGS. 1 and 2, is a preformed metal panel section 10 having a male exterior upper wall which is a tongue and an oppositely disposed female interior lower wall 40 which is a groove. Male upper wall tongue 30 extends for the entire longitudinal length "TGDP-Ll" of panel section 10. Similarly, female lower wall groove 40 extends for the same entire longitudinal length "GGDP-Ll" of panel section 10. From the rear view of FIG. 2, male tongue section 30 has an upper longitudinal wall 35. From the rear view of FIG. 2, female groove section 40 has a lower interior channel 42 and an interior lower longitudinal wall 45. The garage door panel section 10 has a straight left sidewall 50 and a straight right sidewall 60. The male protrusion 32 of male tongue section 30 is designed to fit into the female channel 42 of female groove section 40. Of an adjacent panel section 10. While illustrated as a single garage door panel 10, the panels are typically formed with a length of several feet such as six feet long or eight feet long. The aligned male or tongue section 30 fit into the next upper adjacent female or groove section 40 in the next high panels. Garage door panel section 10 has a straight left sidewall 50 and a straight right sidewall 60. The rear of garage door panel section 10 has a rear chamber 80 formed with rear wall 70, upper longitudinal wall 35 of male tongue section 30, interior lower longitudinal wall 45 of lower groove section 40, left sidewall 50, right sidewall 60 and indented sections 18A-BC and 18B-BC.

Figure 3:
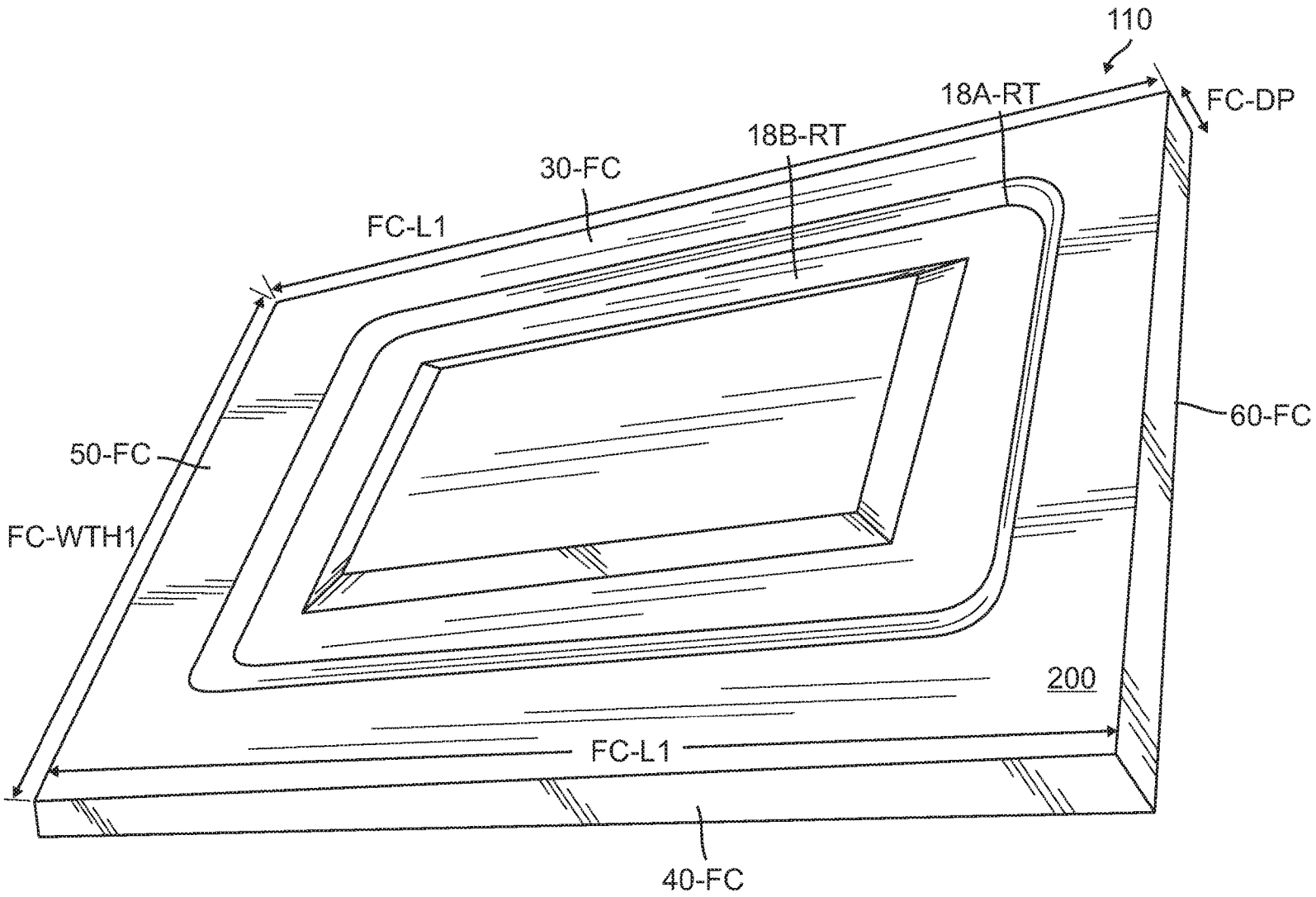
FIG. 3 is a front and left side perspective view of the EPS foam core with a mirror matching custom routing out each backing piece in the front surface of the EPS foam core to fit the stamped embossed design in the steel front panel as illustrated in FIG. 1 and FIG. 2.

Referring to FIG. 3, there is illustrated one innovation of the present invention. Referring to FIG. 3, there is illustrated a front and bottom perspective view of the present invention EPS foam core 110 with mirror matching custom routing out of the front surface 200 backing EPS foam core 110 which as illustrated includes an exterior generally rectangular portion 18A-RT and an interior generally rectangular portion 18B-RT which are centered on a front surface 200 of EPS foam core 110. The EPS foam core 110 has an upper longitudinal wall 30-FC, a lower longitudinal wall 40-FC, a left sidewall 50-FC and a right sidewall 60-FC and a depth of FC-DP which are sized to fit into the rear cavity 80 of garage door panel section 10. Rear cavity 80 is bounded by rear wall 70 with the mirror matching indentations 18A-BC and 18B-BC, upper longitudinal wall 35, lower longitudinal wall 45, left sidewall 50 and right sidewall 60.

As illustrated in FIG. 3, the EPS foam core protrusions exactly match the stamped decoration 18A and 18B in front steel garage door panel 10 with a decorative design formed therein such as by stamping embossing, etc. stamped into the panel as viewed from the front of the panel.

Figure 4:
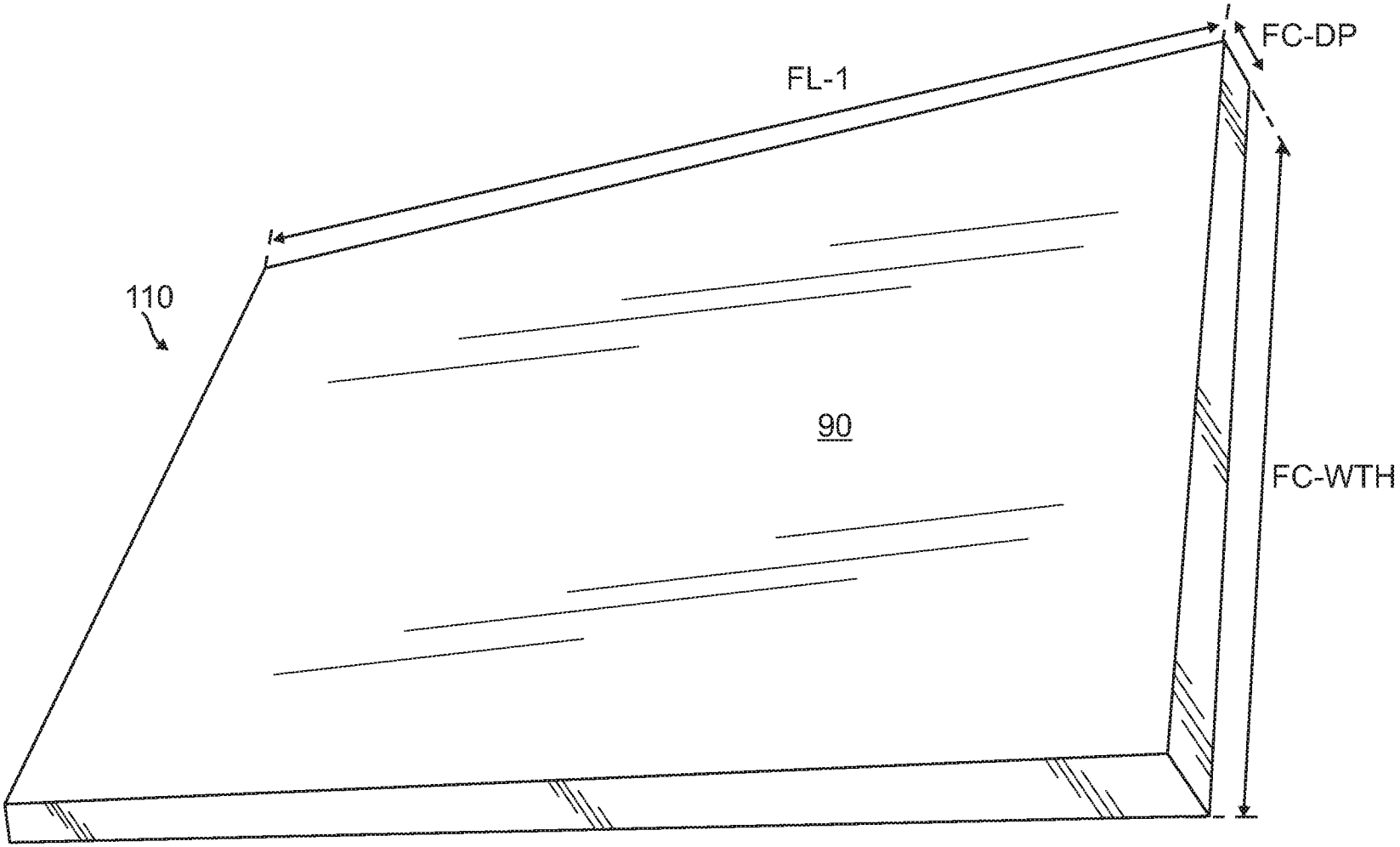
FIG. 4 is a rear and right side perspective view of the flat back surface of the EPS foam core.

Referring to FIG. 4, there is illustrated a rear perspective view of the EPS foam core 110 with a flat rear surface 90. The rear surface 90 of the EPS foam core 110 is flat.

The components of the garage door panel are bonded to each other with glue or a spray on adhesive of isocyanate and polyol resin which are separately sprayed onto the surface to be bonded. They mix when they come in contact to create a hardened polyurethane foam. It is within the spirit and scope of the present invention to apply the adhesive to one of the two surfaces to be bonded together or to both surfaces to be bonded together.

Figure 5:
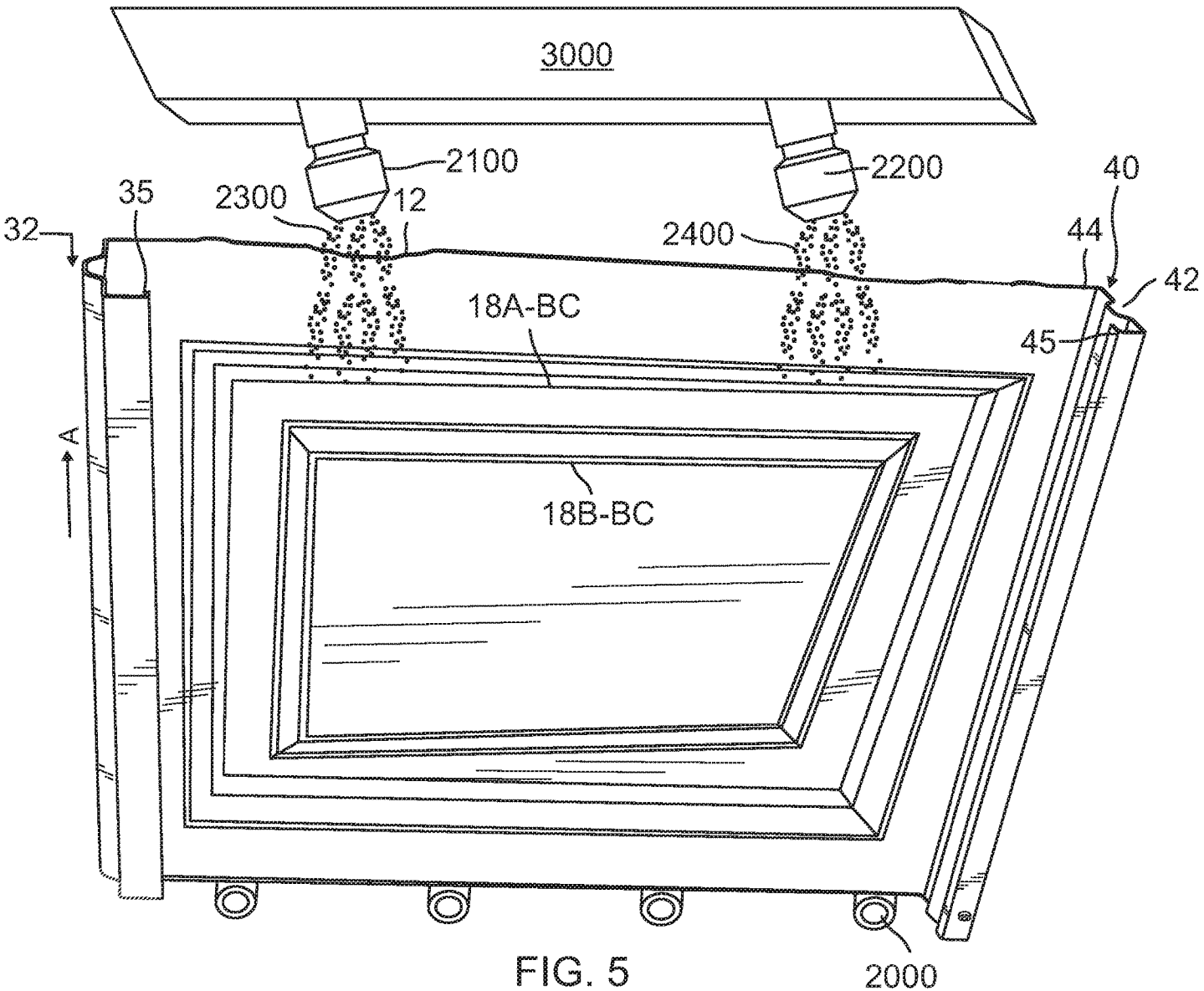
FIG. 5 is an interior perspective view of the formed metal garage door panel with a decoration stamped into the panel as disclosed in FIG. 2, with spray nozzles above the interior wall spraying compound onto the rear surface of the formed metal garage door panel.

Referring to FIG. 5, there is illustrated an interior perspective view of the formed metal garage door panel with a decoration stamped into the panel as disclosed in FIG. 2 with spray nozzles above the interior wall spraying compound onto the rear surface of the formed metal garage door panel. The garage door panel 10 is placed front surface 20 down on rollers 2000 with the rear cavity 80 and its previously described components face up and transported under a canopy 3000 with a spray head 2100 spraying isocyanate 2300 on rear surface 70 and a separate spray head 2200 spraying polyol resin 2400 onto rear surface 70 and spread over interior indentations 18A-BC and 18B-BC until they mix into a combination hardened polyurethane foam. Alternatively, the bonding compound can be comprised of a one-part moisture cured urethane adhesive. Alternatively, in addition to spraying as set forth above, it is also within the spirit and scope of the present invention to apply the isocyanate 2300 and the polyol resin 2400 by roller coating. It is also within the spirit and scope of the present invention to apply the one-part moisture cured urethane adhesive with roller coating and/or spray coating.

Referring once again to FIG. 5, there is illustrated adhesive applied to the rear surface of the embossed steel panel 10. The length of the steel decoration embedded panel 10 is placed face down of rollers 2000 so that the rear surface 62 with embossed decorations 18A-BC and 18B-BC is face up. The length of panel 10, which would be eight feet long, is placed on a roller 2000 and adhesive components which are isocyanate 2300 and polyol resin 2400 are separately sprayed onto the rear surface 100 by respective spray nozzles and 2100 and 2200 and mix when they come in contact. The mixed combination hardens into a polyurethane foam/glue adhesive. The routed foam core 110 is placed onto the rear surface 70 and is adhered to the rear surface with the exact matching routed shape matched against the interior of the formed decoration extending into the panel section interior surface 70 of the panel section 10.

Figure 6:
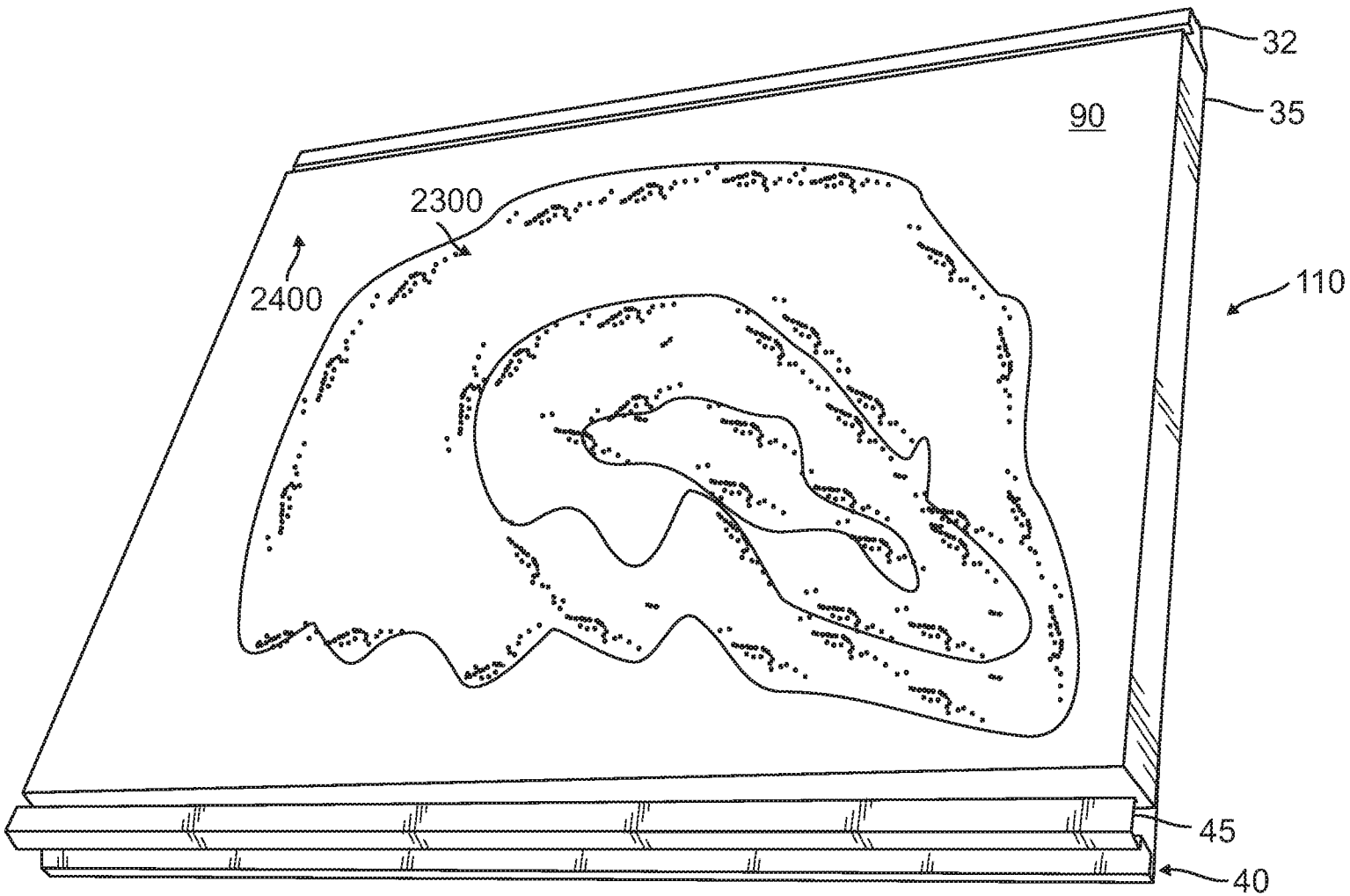
FIG. 6 is a rear and right side perspective view of the garage door panel with the EPS foam core inserted into the rear cavity and the front surface of the EPS foam core bonded to the rear surface of the garage door panel, also illustrating adhesive applied to the rear surface of the EPS foam core.

Referring to FIG. 6, there is illustrated a rear and right side perspective view of the garage door panel with the EPS foam core inserted into rear cavity 80 and the front surface 200 bonded to the rear surface 70. The front surface 200 of the foam core 110 is also sprayed with adhesive isocyanate 2300 and polyol resin 2400. The front surface of the foam core 110 is adhered to the interior surface 70 of the embossed steel plate garage door panel 10. The front surface is exactly aligned with and matching the embossed design stamped into the front steel plate. The EPS foam core 110 is exactly sized to fit into the interior rear chamber 80 of panel section 10 with foam core top surface 30-FC against interior wall 35 of male tongue wall 30, it's bottom surface 40-FC against the interior wall 45 of groove 40 or female sidewall 40. The left sidewall 50 of the panel 10 is exactly aligned with the left sidewall 50-FC of foam core 110. The right sidewall 60 of the panel 10 is exactly aligned with the right sidewall 60-FC of foam core 110. The rear surface 90 of the foam core 110 is also sprayed with adhesive isocyanate 2300 and polyol resin 2400.

Figure 7:
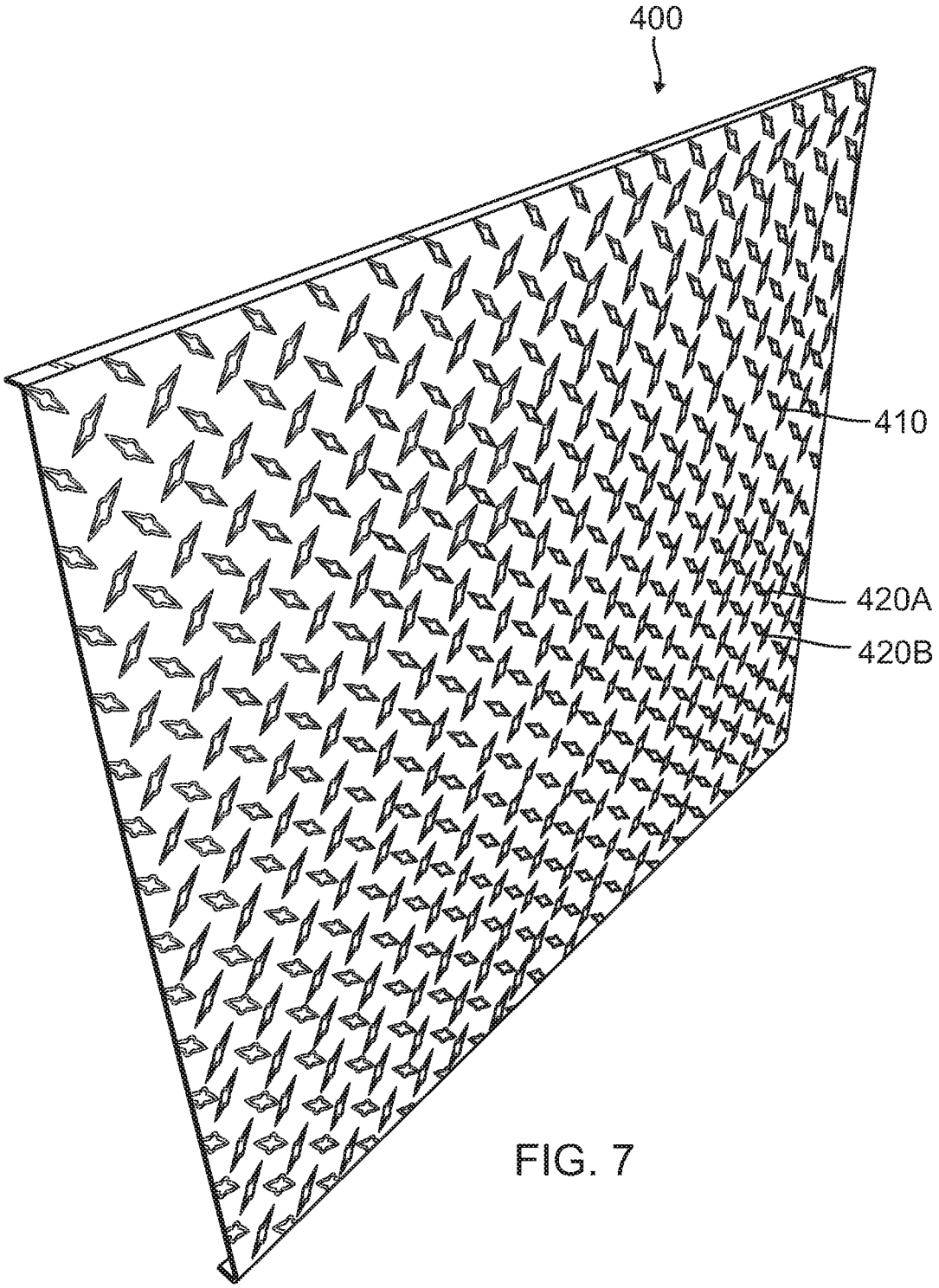
FIG. 7 is a front and side perspective view of a sheet of aluminum diamond plate which is used as the backing sheet for the garage door panel.

Referring to FIG. 7, there is illustrated a front and side perspective view of a sheet of aluminum diamond plate 400 which is used as the backing sheet for the garage door panel 10. The front surface 410 has a multiplicity of outwardly extending protrusions 420A and a multiplicity of outwardly extending cross-protrusions 430B. The addition of the aluminum diamond plate sheet 400 as a backing sheet for the garage door panel 10 is a very significant improvement over the prior art.

Figure 8:
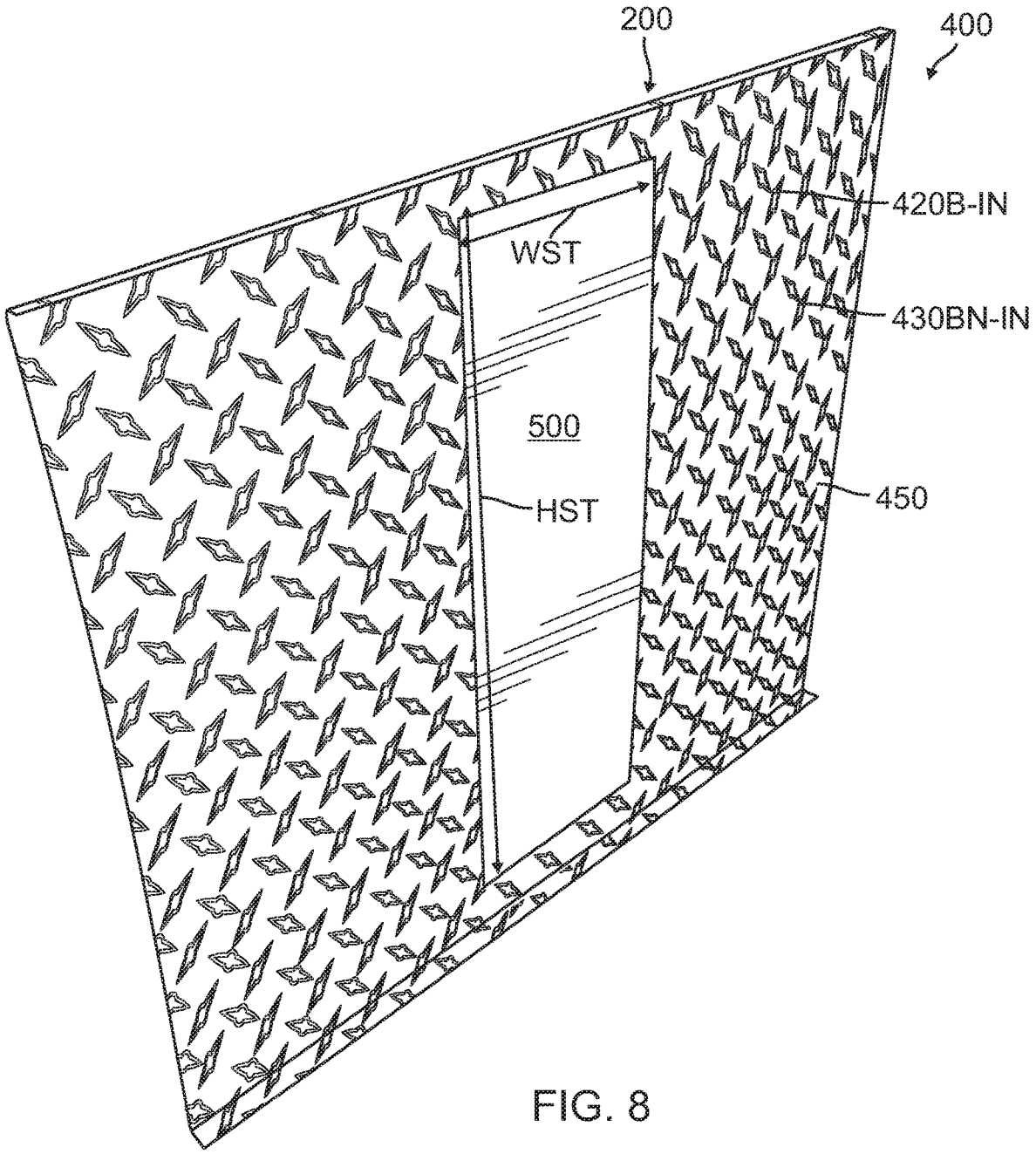
FIG. 8 is a rear perspective view of the sheet of aluminum diamond plate and a sheet of steel retained against the rear surface.

Referring to FIG. 8, there is illustrated a rear perspective view of the sheet of aluminum diamond plate 400 having a rear surface 450 with matching indentations 420A-IN and 430B-IN corresponding to the forwardly extending protrusions 420A and 430B on the front surface. Further referring to FIG. 10, a sheet of steel with a height "HST" and a width "WST" is retained against the rear surface 450 of aluminum diamond plate sheet 400. If the aluminum diamond plate sheet has a height of 21 inches, then the height "HST of the steel plate is 19 inches and the width of the steel plate "WST" is 6 inches. If the height of the aluminum diamond plate sheet is 18 inches, then the height of the steel plate is 16 inches and the width remains at 6 inches. Finally, if the height of the aluminum diamond plate sheet is 24 inches, then the height of the steel plate is 22 inches and the width remains at 6 inches.

Figure 9:
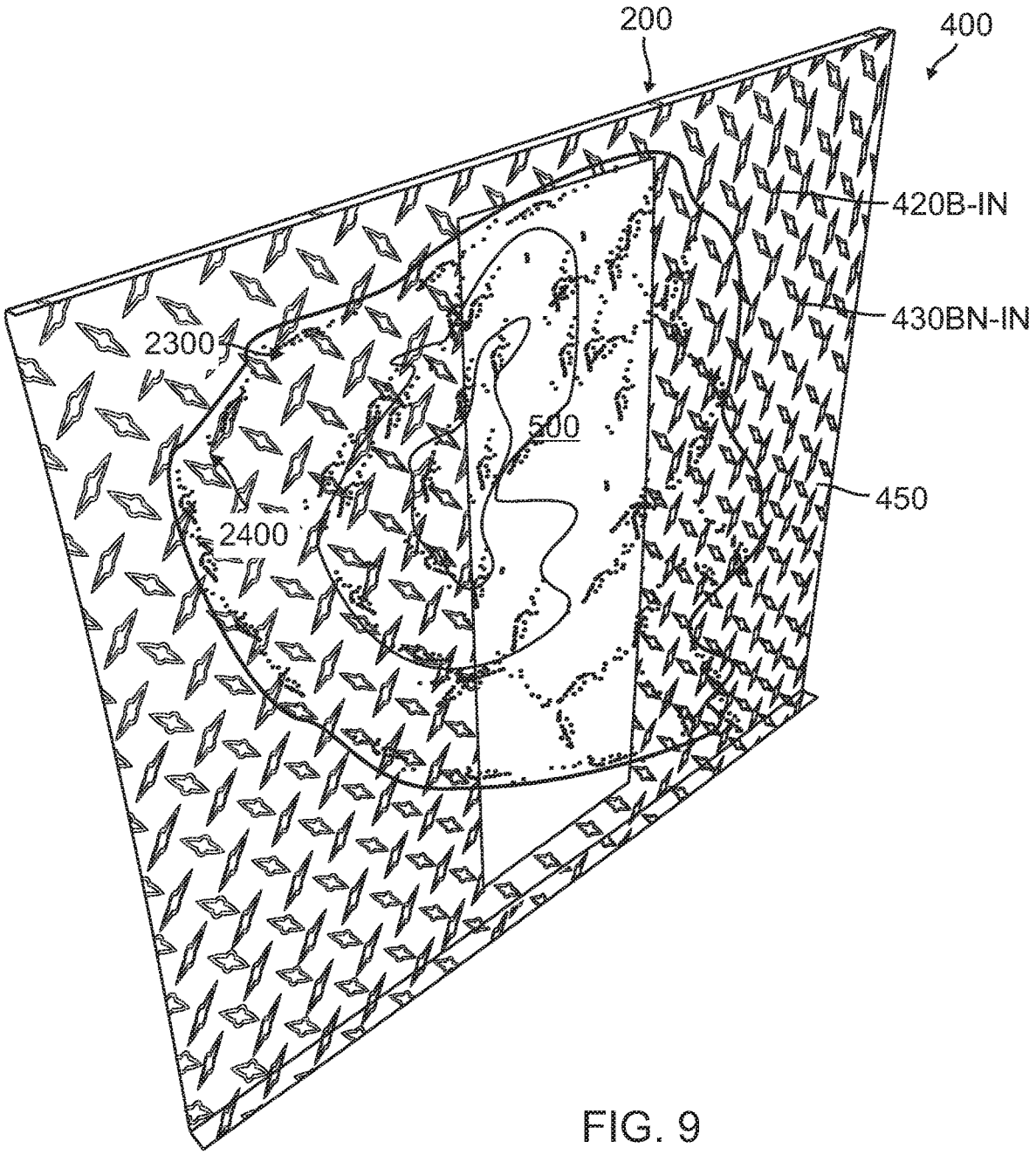
FIG. 9 is a rear perspective view of the sheet of aluminum diamond with a the sheet of steel and adhesive such as isocyanate and polyol resin applied to the rear surface.

Referring to FIG. 9, there is illustrated adhesive such as isocyanate 2300 and polyol resin 2400 applied to the rear surface 450 of aluminum diamond plate sheet 400. The aluminum diamond plate sheet 400 is then bonded to the rear surface 90 of the EPS foam core. 110.

Figure 10:
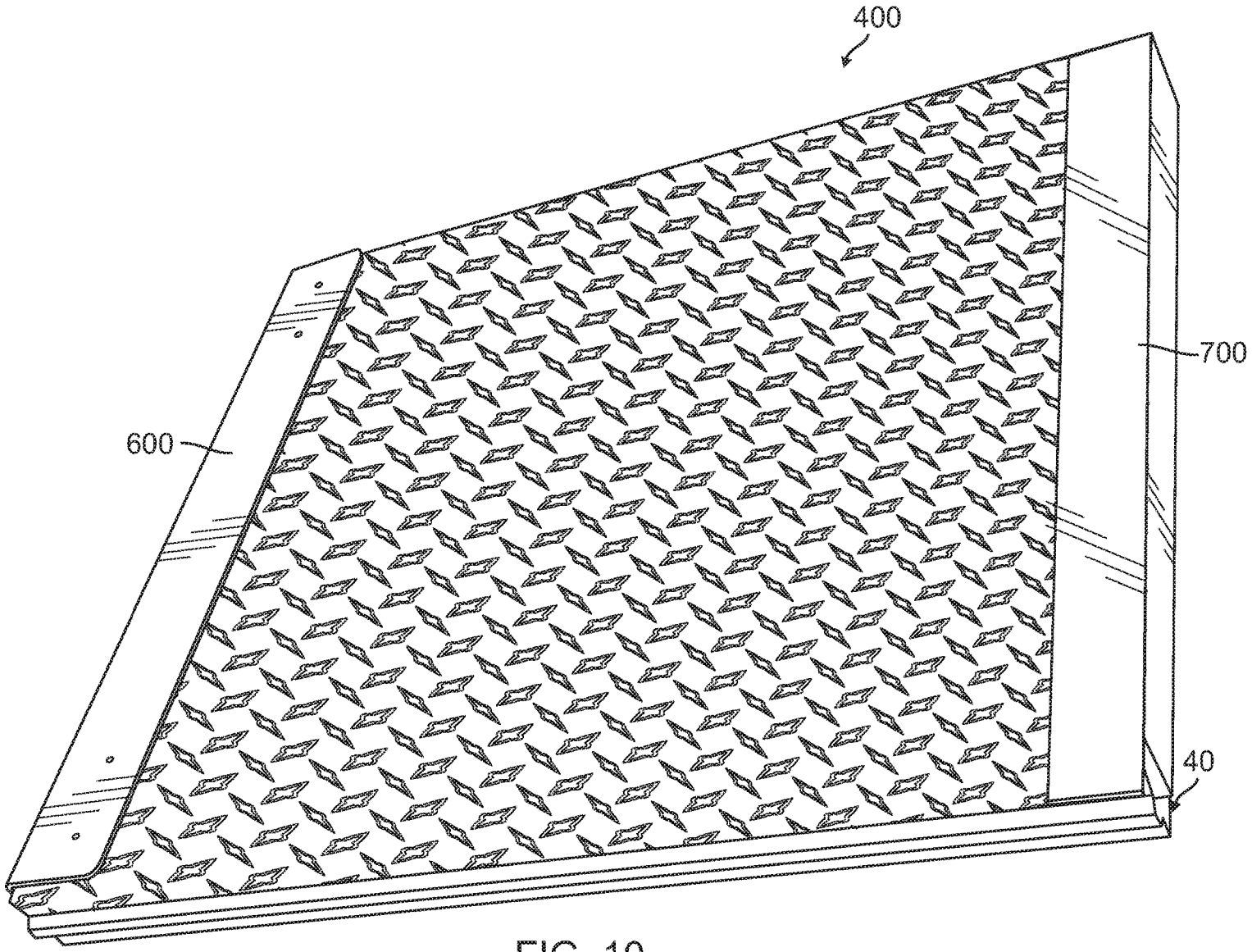
FIG. 10 is a rear perspective view of the aluminum diamond plate sheet retained against the completed garage door panel and left and right stiles at each respective end.

Referring to FIG. 10, there is illustrated a completed garage door panel 1000 which includes end stiles described below. In summary, the key innovations of the present invention are as follows:

1. The garage door panel is formed out of metal, preferably steel, with an ornamental design formed into a surface, preferably a front surface, of the metal panel, the rear of the panel having an interior cavity with a mirror recess of the design in the rear surface;
2. A foam core is used as a backing material and a key innovation is that a front surface of the foam core which is adhered to the rear surface of the garage door panel has a matching design routed into the core which is preferably made of polystyrene EPS core of 1.5 to 2.0 pound foam core insulation which is sized to exactly fit into the cavity in the rear of the metal garage door panel;
3. An aluminum diamond plate is adhered to the rear surface of the polystyrene EPS core of 1.5 to 2.0 pound foam;
4. Optionally a sheet of steel, six inched wide and slightly shorter than the aluminum diamond plate sheet is retained against the rear surface of the aluminum diamond plate sheet before it is affixed to the polystyrene EPS core.

The stiles will not be described.

Figure 11:
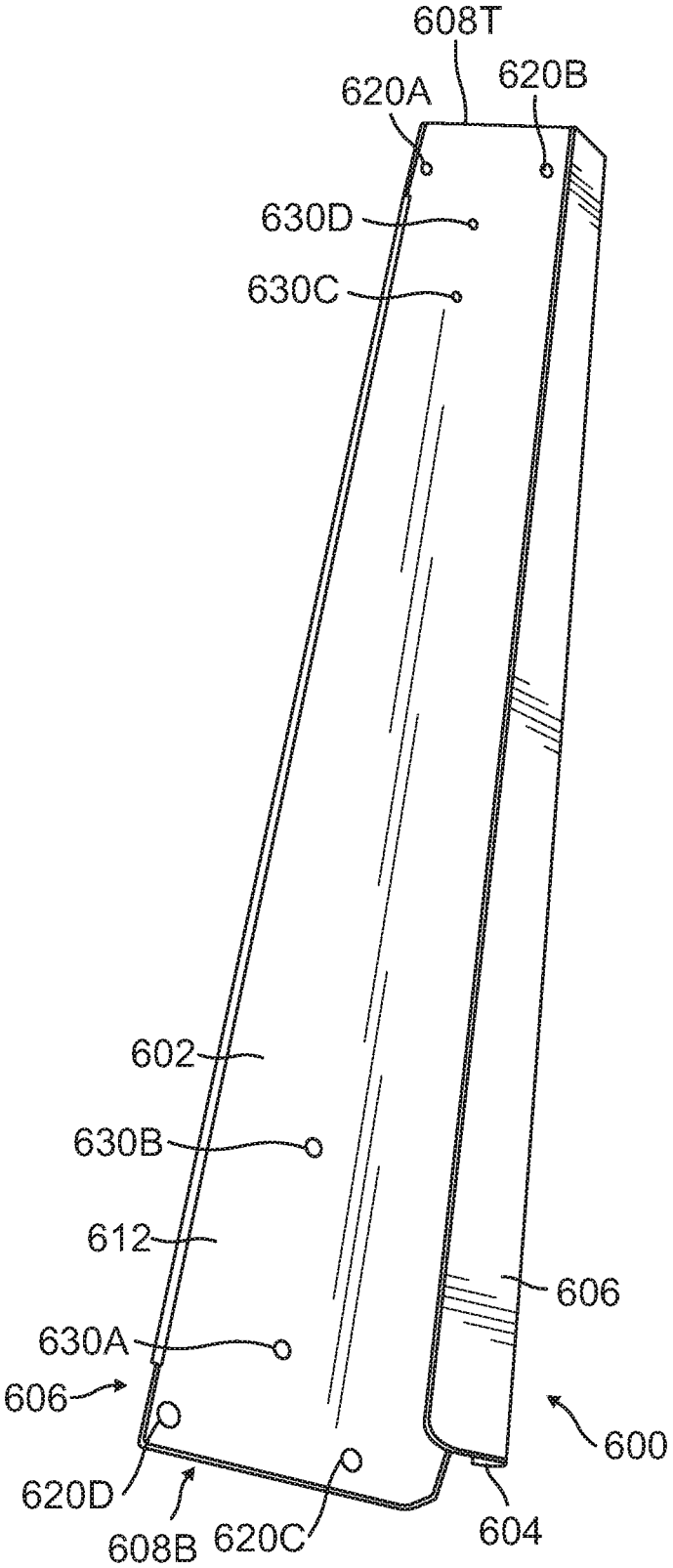
FIG. 11 is a rear perspective view of a left stile.

Referring to FIG. 11, there is illustrated a front perspective view of a left end stile 600 having a rear vertical wall 602, a side vertical wall 604 and a front vertical wall 606. All three left stile walls 602, 604 and 606 meet at approximately ninety degree angles to form the left end stile 600 having a generally "L"-shaped cross-section. End stile rear vertical wall 602 has a rear wall surface 612 with four rivet holes 620A, 620B, 620C and 620D that accept rivets or screws or other similar standard affixing members to enter through the four rivet holes to attach left end stile to preformed garage panel 10. Two of the rivet holes 620A and 620B are located near left stile end top portion 608T and two of the rivet holes 620C and 620D are located near left stile bottom portion 608B. The four rivet holes working collectively together allow the fixing members to affix the left end stile 600 to a left end of the preformed garage panel. Rear wall 602 also includes four hinge holes 630A, 630B, 630C and 630D which are used to affix a portion of a hinge to each stile. The hinges allow the garage door panels to pivot or rotate as the garage door moves up and down along a track.

Figure 12:
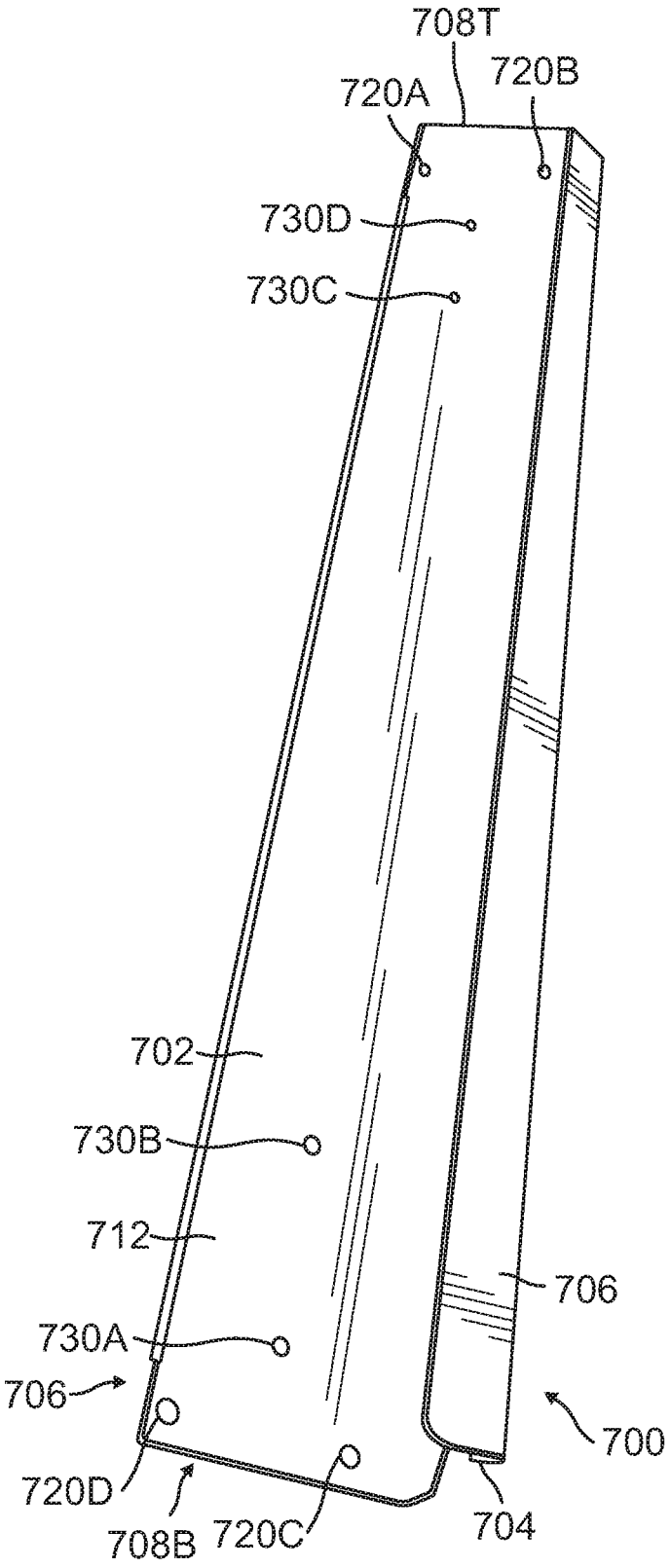
FIG. 12 is a rear perspective view of a right stile.

Referring to FIG. 12, there is illustrated a front perspective view of a right end stile 700 having a rear vertical wall 702, a side vertical wall 704 and a front vertical wall 706. All three left stile walls 702, 704 and 706 meet at approximately ninety degree angles to form the left end stile 700 having a generally "L"-shaped cross-section. End stile rear vertical wall 702 has a rear wall surface 712 with four rivet holes 720A, 720 B, 720 C and 720D that accepts rivets or screws or other similar standard affixing members to enter through the four rivet holes to attach left end stile to preformed garage panel 10. Two of the rivet holes 720A and 720B are located near left stile end top portion 708T and two of the rivet holes 720C and 720D are located near left stile bottom portion 708B. The four rivet hole working collectively together allow the fixing members to affix the right end stile 700 to a right end of the preformed garage panel 10. Rear wall 702 also includes four hinge holes 730A, 730B, 730C and 730D which are used to affix a portion of a hinge to each stile. The hinges allow the garage door panels to pivot or rotate as the garage door moves up and down along a track.

Figure 13:
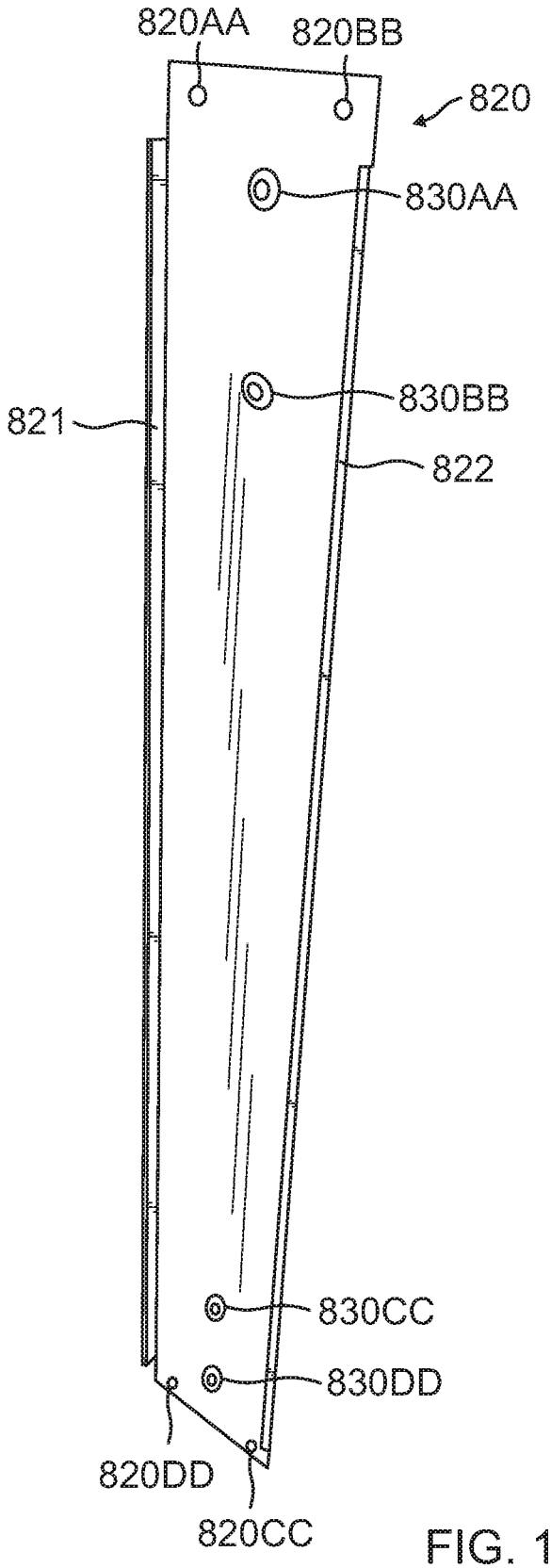
FIG. 13 is a perspective view of a middle stile.

Referring to FIG. 13, there is illustrated a front perspective view of a middle stile 820 which is placed at intervals between left end stile 600 and right end stile 700. The middle stile contains rivet holes 820AA, 820BB, 820CC and 820DD. The middle stile also contains hinge bracket holes which are 830AA, 830BB, 830C and 830DD. Optionally, the middle stile contains sidewalls 821 and 822. As an example, if a garage door panel is eight feet long, a left end stile is at one end, a right end stile is at an opposite end, and the middle stile is used in the center. A sixteen foot garage door panel would use three middle stiles. A fourteen foot garage door panel would use two middle stiles.

Figure 14:
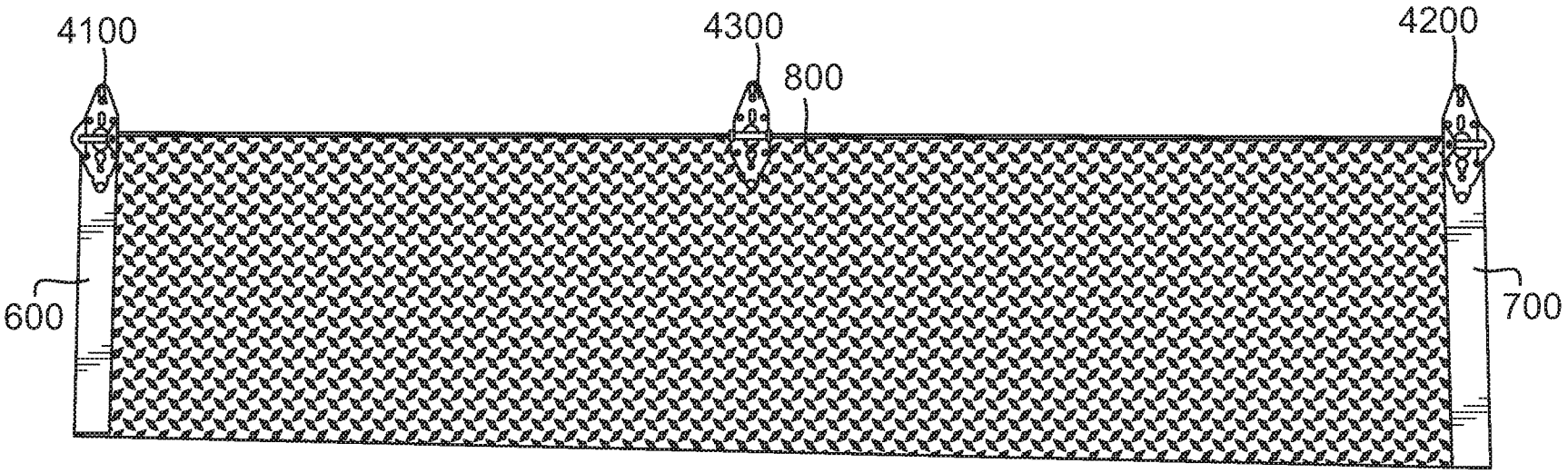
FIG. 14 is a rear perspective view of a completed garage door panel.

Referring to FIG. 14, there is illustrated a rear perspective view of a completed garage door panel illustrating the steel diamond plate which is the full extending length of a full garage door panel which is numbered 800, with a left end stile 600, a right end stile 700 and a middle stile which is not illustrated in the center of the garage door panel along with hinge bracket 4100, hinge bracket 4200 and hinge bracket 4300. In this particular design, the combined garage door panels are only 8 feet long and therefore, only one middle stile was used.

Figure 15:
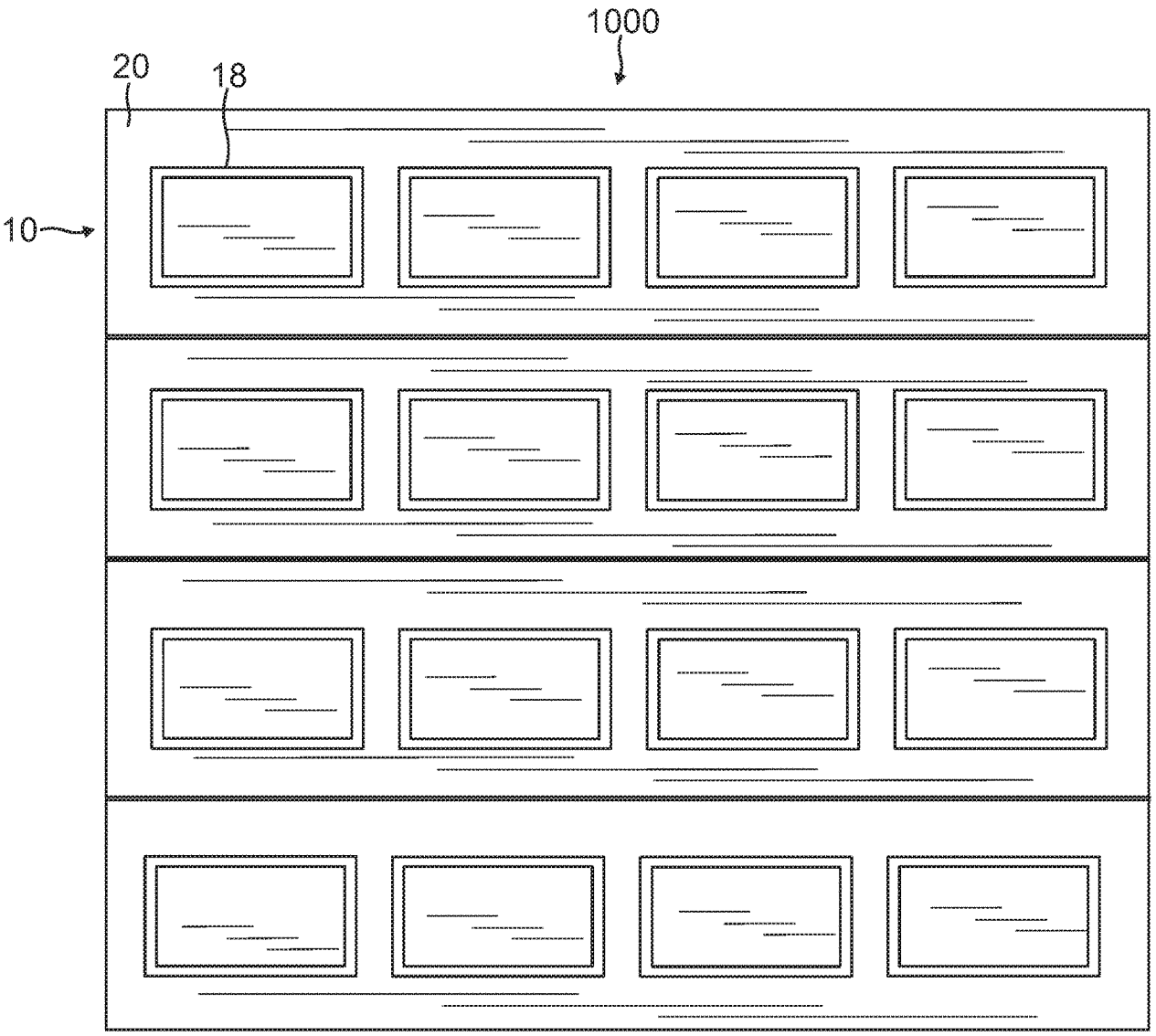
FIG. 15 is a perspective view of a completed garage door.

Referring to FIG. 15, there is illustrated a rear view of an entire garage door panel 1000 comprised of four (4) of the present invention garage door panels 10. From this front view the rectangular decorative indents 18 on panel front surface 20 are viewable.

Further, there is illustrated a front view of a portion of four (4) garage door panels 10, each of which is only eight (8) feet wide comprised of four (4) of the present invention garage door panels 10 but not illustrating the top male portion 32 on the uppermost panel. The garage door panes 10 each have a length of only eight (8) feet.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A portion of a garage door panel comprising:

(a) a pre-formed metal section having a front surface and a rear surface, a decoration formed into and protruding outwardly from the front surface, the rear surface including an indentation into the rear surface conforming in shape to the decoration protruding outwardly from the front surface, the pre-formed metal section including a rear cavity having a length, width and depth bounded by said rear surface and its indentation, an upper longitudinal wall, a lower longitudinal wall, a left end and a right end;

(b) an expanded polystyrene core of 1.5 to 2.0 pound foam having a front surface including a routed decoration mirror matching said indentation in said rear surface of said preformed metal section, the expanded polystyrene core of 1.5 to 2.0 pound foam having a length, width and depth to fit into said cavity, and having a flat back surface;

(c) an aluminum diamond plate sheet having a front surface with a multiplicity of protrusions extending forwardly from the front surface, the aluminum diamond plate sheet having and a rear surface with a multiplicity of indentations matching said protrusions in said front surface;

(d) a sheet of steel retained against the rear surface of said aluminum diamond plate sheet;

(e) said aluminum diamond plate sheet having a length and width to conform to the length and width of said rear cavity of said pre-formed metal sheet; and (f) the front surface of said expanded polystyrene core of 1.5 to 2.0 pound foam bonded to said rear surface of said pre-formed metal section including said routed decoration bonded into said indentation in said rear surface, and the rear surface of said aluminum diamond plate sheet bonded to said flat back surface of said expanded polystyrene core of 1.5 to 2.0 pound foam.

2. The portion of a garage door panel in accordance with claim 1, further comprising: said front surface of said expanded polystyrene core of 1.5 to 2.0 pound foam bonded to said rear surface of said pre-formed metal section by a bonding compound comprising a combination of isocyanate and polyol resin and said routed decoration is also bonded into said indentation in said rear surface by the bonding compound comprising a combination of isocyanate and polyol resin.

3. The portion of the garage door panel in accordance with claim 1, further comprising: said rear surface of said aluminum diamond plate sheet bonded to said flat back surface of said expanded polystyrene core of 1.5 to 2.0 pound foam by a bonding compound comprising a combination of isocyanate and polyol resin.

4. The portion of the garage door panel in accordance with claim 1, further comprising: said sheet of steel is six inches wide and magnetic decorations retained against the front surface of said aluminum diamond plate sheet by magnetic attraction to said sheet of steel.

5. A portion of a garage door panel comprising:

(a) a pre-formed metal section having a front surface and a rear surface, at least one decoration formed into and protruding outwardly from the front surface, the rear surface including at least one indentation into the rear surface conforming in shape to the at least one decoration protruding outwardly from the front surface, the pre-formed metal section including a rear cavity having a length, width and depth bounded by said rear surface and its at least one indentation, an upper longitudinal wall, a lower longitudinal wall, a left end and a right end;

(b) an expanded polystyrene core made of foam having a front surface including at least one routed decoration mirror matching said at least one indentation in said rear surface of said preformed metal section, the expanded polystyrene core made of foam having a length, width and depth to fit into said cavity, and having a back surface;

(c) an aluminum diamond plate sheet having a front surface with a multiplicity of protrusions extending forwardly from the front surface, the aluminum diamond plate sheet having and a rear surface with a multiplicity of indentations matching said protrusions in said front surface;

(d) said aluminum diamond plate sheet having a length and width to conform to the length and width of said rear cavity of said pre-formed metal sheet;

(e) the front surface of said expanded polystyrene core made of foam bonded to said rear surface of said pre-formed metal section including said at least one routed decoration bonded into said at least one indentation in said rear surface, and the rear surface of said aluminum diamond plate sheet bonded to said back surface of said expanded polystyrene core made of foam; and (f) a six inch wide sheet of steel retained against said rear surface of said aluminum diamond plate sheet.

6. The portion of the garage door panel in accordance with claim 5, further comprising: said front surface of said expanded polystyrene core made of foam bonded to said rear surface of said pre-formed metal section by a bonding compound comprising a combination of isocyanate and polyol resin and said at least one routed decoration is also bonded into said at least one indentation in said rear surface by the bonding compound comprising a combination of isocyanate and polyol resin.

7. The portion of the garage door panel in accordance with claim 5, further comprising: said rear surface of said aluminum diamond plate sheet bonded to said back surface of said expanded polystyrene core of 1.5 to 2.0 pound foam by a bonding compound comprising a combination of isocyanate and polyol resin.

8. The portion of the garage door panel in accordance with claim 5, further comprising: magnetic decorations retained against the front surface of said aluminum diamond plate sheet by magnetic attraction to said six inch wide sheet of steel.

9. A method of forming a portion of a garage door panel comprising:

(a) using a steel front plate with a front surface and a rear surface, forming at least one decoration indented into said rear surface with the same at least one decoration aligned with the at least one decoration indentation and protruding into and forwardly from the front surface of the steel front plate;

(b) using an expanded polystyrene foam core with a front surface and a rear surface and routing out at least one decoration in the front surface which protrudes forwardly from the front surface and is aligned with and mirror matches the at least one decoration indentation formed into said rear surface of the steel front plate;

(c) binding the front surface of the polystyrene foam core to the rear surface of the steel front plate and also bonding the at least one decoration into the at least one decoration indentation formed into said rear surface of the steel front plate; and (d) using an aluminum diamond plate sheet having a front surface and a rear surface with a sheet of steel retained against the e surface and bonding the rear surface and the sheet of steel to a rear surface of said polystyrene foam core.

10. A method of forming a portion of a garage door panel in accordance with claim 9, further comprising:

using an aluminum diamond plate sheet having a front surface and a rear surface and bonding the rear surface to a rear surface if said polystyrene foam core.

* * * * *